United States Patent [19]

Centafanti

[11] Patent Number: 4,877,250

[45] Date of Patent: Oct. 31, 1989

[54] PORTABLE GOLF PUTTING COURSE

[76] Inventor: Rocco Centafanti, 27 India St., Portland, Me. 04101

[21] Appl. No.: 153,601

[22] Filed: Feb. 8, 1988

[51] Int. Cl.[4] ..... A63B 69/36

[52] U.S. Cl. ..... 273/176 FB; 273/DIG. 30; 273/DIG. 13; 273/195 R

[58] Field of Search ..... 273/176 R, 176 AB, 176 F, 273/176 J, 176 FB, 195 A, DIG. 13, DIG. 30, 126 R, 87 R, 87 C, 87 H, 195 R, 183 A, 181 K, 176 G, 176 E, 127 R

[56] References Cited

U.S. PATENT DOCUMENTS

| | | | |
|---|---|---|---|
| 445,016 | 1/1891 | Greene | 273/126 R |
| 1,886,399 | 11/1932 | Hause | 273/167 F |
| 3,342,494 | 7/1964 | Talley, Jr. | 273/176 F |
| 3,342,495 | 9/1967 | Wasley | 273/176 F |
| 3,669,454 | 6/1972 | Kolonel | 273/176 F |
| 3,897,067 | 7/1975 | Smith | 273/176 G |
| 4,203,604 | 5/1980 | LaGrange | 273/176 FB |

*Primary Examiner*—Edward M. Coven
*Assistant Examiner*—Sebastiano Passaniti

[57] ABSTRACT

A portable putting course consists of a surface layer of a material suitable as a putting surface bonded to an underlying layer of flexible, resiliently compressible material. A flexible barrier partially surrounds and is detachably attached to one end of the course on which, in the disclosed embodiment, objectives are painted for golf balls putt from the other end of the course.

1 Claim, 2 Drawing Sheets

Fig. 3
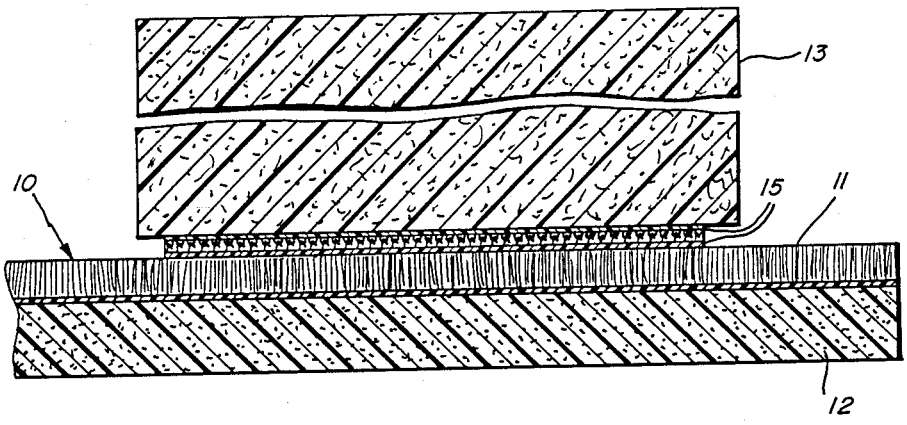
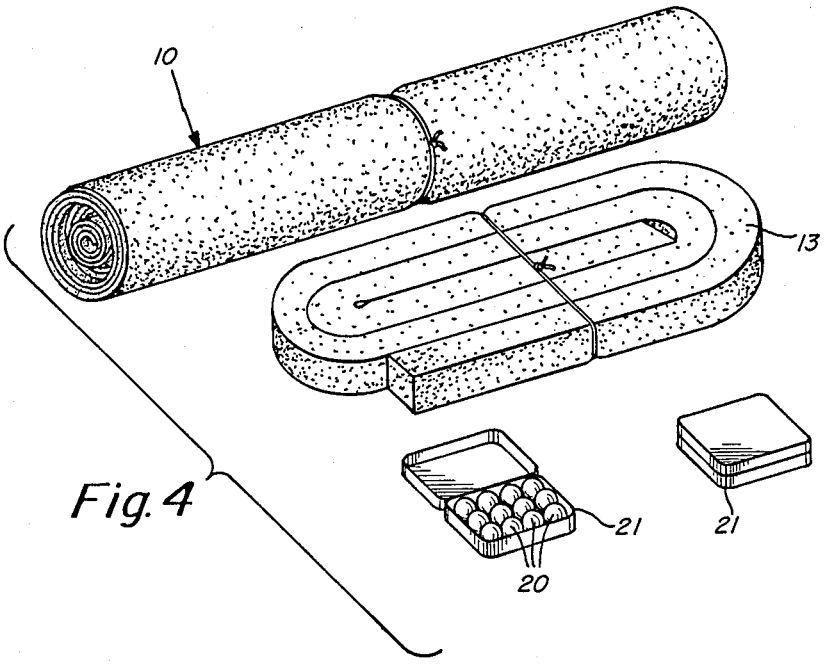
Fig. 4

PORTABLE GOLF PUTTING COURSE

BACKGROUND OF THE INVENTION

There are, of course, a wide range of indoor games but there are only a few which actually enable an outside activity to be continued indoors.

Of these, since the use of a putter requires a relatively small practice or playing surface, golf games have been proposed taking advantage of that fact.

THE PRESENT INVENTION

The general objective of the present invention is to provide a portable playing surface which is a close approximation of a putting green and adapted for use in practising putting or as a game where putting skills count.

In accordance with that objective, a putting course consists of a playing surface of artificial turf bonded to a surface of a flexible underlying layer of a resiliently compressible, non-slip material. The course is provided with an objective at one end for a ball putted from the other end. Such a course may be easily rolled up when not in use or unrolled when its use is wanted.

Another feature of the invention is the use of removable, flexible barrier partly surrounding the objective area of the course and opening towards the end of the course from which golf balls are putt.

Another objective of the invention is to adapt the course for use in a game requiring two or more players. For that purpose, the course in addition to having a hole-representing objective is the form of a printed circle may also be provided with other printed circles surrounding it but which have a lesser value.

The players take turns in putting and attempt either to have a ball come to rest on a circle or to dislodge an opponent's ball therefrom. Not only does the barrier prevent practice balls from rolling from the course or game balls from so doing but it also enables a ball putt with the intention of displacing a ball of the opponent and striking the barrier to bounce forwardly towards a scoring circle.

BRIEF DESCRIPTION OF THE DRAWINGS

The accompanying drawings illustrate a preferred embodiment of the invention

FIG. 3 is a section, on a further increase in scale, taken approximately along the indicated line 3—3 of FIG. 2; and FIG. 4 is a view of the components of the course prepared for storage.

THE REFERRED EMBODIMENT OF THE INVENTION

In the disclosed embodiment, the portable putting course, generally indicated at 10, is shown as consisting of a playing surface 11, which is a flexible layer of a material suitable for use as a putting surface of which artificial turf is a preferred example. Such a layer is about a quarter of an inch in thickness and is bonded to a layer 12 of flexible, yieldably resilient material such, for example, as that used under carpeting and approximately twice as thick as the putting surface 11.

Figure 1:
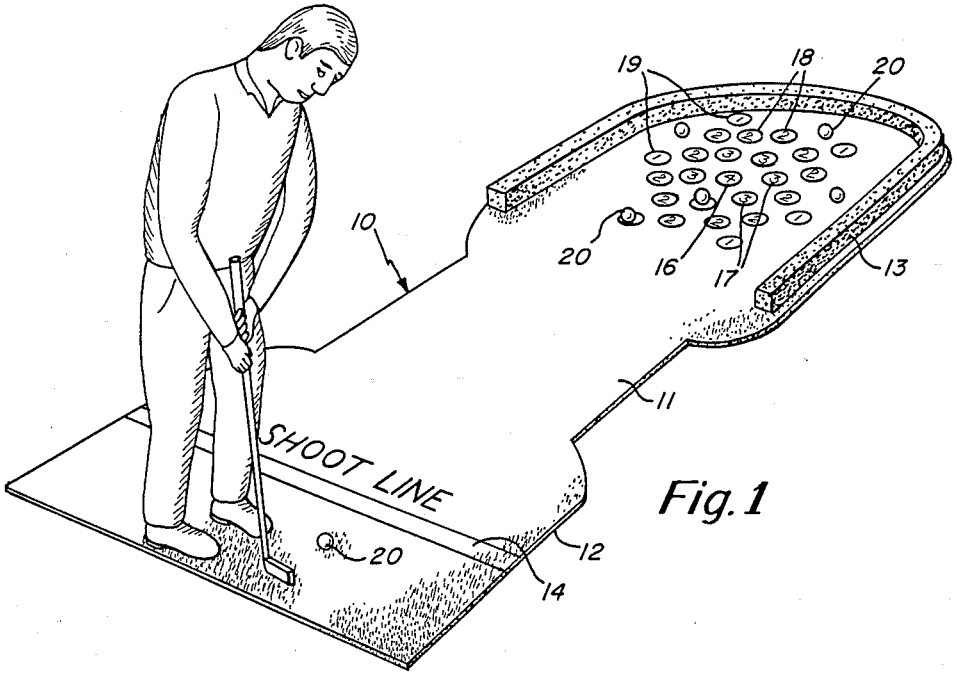
FIG. 1 is a perspective view of the course.
Figure 2:
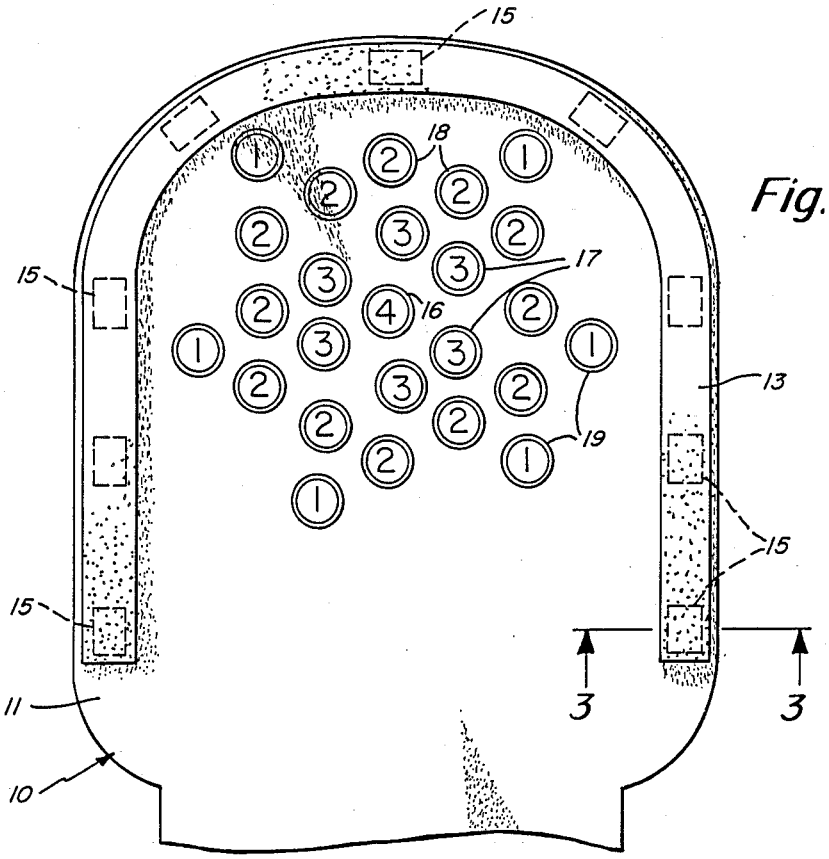
FIG. 2 is a plan view, on an increase in scale, of the scoring area of the course.

One end of the course 10 has a U-shaped, detachable and resiliently flexible barrier 13 partially surrounding the objective area and opening towards the other end of the course which is shown as having a line 14 from or behind which putts are to be made. The barrier 13 is attached to the course 10, as by a series of Velcro interengagable sections 15, see FIG. 2, so spaced as to secure it in its wanted position, and it is sufficiently flexible to enable it to be folded upon itself to minimize the space required for its storage.

With the barrier removed, the course 10 may be rolled up for storage, see FIG. 4, and when it is again to be used, it is easily unrolled and lies, without creases, flat on a floor or on a reasonably flat outside area. Because of the flexibility of the course, it may, when used indoors, be laid over an article or articles to make the planned course of a putt golf ball more difficult to determine. When used outdoors, the ground on which the course is laid is commonly sufficiently irregular to provide that result.

The objective of putting is, of course, the cup which in the disclosed embodiment of the invention is a painted or printed circle 16. With the course 10 as above described, it will be found that it is somewhat faster than the average green. For practical reasons, the length of the course is limited and with a course twelve feet long, considerable care is required to have a putt ball come to rest on the circle 16.

While putting practices require only one objective, an interesting game is provided by giving the circle 16 a scoring value, four, for example, and by printing four series of circles 17, 18, and 19, substantially concentric with the circle 16 and by giving each series a value progressively less in the order named.

In such a game, each of two players is provided with the same number of golf balls, 20 in a box 21 with the balls for the two players of different colors. The players take turns in putting either to place a ball on a selected one of the circles or to dislodge an opponent's ball therefrom without having the dislodged ball land on another circle. The barrier 13 is sufficiently resiliently compressible, Styrofoam for one example, that a player may use it to deflect a putt ball from the rear of the objective area with a somewhat cushioned rebound forwardly towards a circle. More than two persons may play the game, but the number of golf balls used per game should not be increased above a dozen for each of the two players or the sides.

I claim:

1. A course for use in playing a game with a putter and golf balls, said course including a greens section of substantial length and having first and second ends and of uniform thickness throughout its length, said green section consisting of a flexible surface layer, a substantially thicker and flexible underlying layer of the size and shape of the surface layer, said layers united in face to face contact, the exposed material of the surface layer offering a non-deflective degree of opposition to a putt ball and provided at the second end with at least one objective painted or printed on the surface layer towards which a ball is to be putted from the first end, the width of said course such that a person about to putt may stand on the first end in a substantial range of positions transversely thereof, the underlying layer of sufficient firmness to provide non-wrinkling support for the surface layer, said course sufficiently flexible to enable the course to be formed into a roll for shipment or storage, a U-shaped retaining wall, and means detachably attaching the wall to the second end with the wall opening towards the first end with the objective spaced from but bordered by said wall, said means comprising sections of hook and eye fasteners spaced from each other on the upper surface of the greens section and the surface of the wall to be secured thereto, the hook and loop sections arranged to enable the wanted U-shape of the wall to be established when corresponding portions of the wall and of the greens sections are in mutual contact, said wall sufficiently flexible to enable the wall, when detached, to be folded upon itself for shipment or storage.

* * * * *